US009730852B2

(12) United States Patent
Malosio et al.

(10) Patent No.: US 9,730,852 B2
(45) Date of Patent: Aug. 15, 2017

(54) DEVICE FOR THE REHABILITATION OF MOVEMENTS OF THE FOOT

(71) Applicant: CONSIGLIO NAZIONALE DELLE RICERCHE, Rome (IT)

(72) Inventors: Matteo Malosio, Rome (IT); Simone Pio Negri, Rome (IT); Nicola Pedrocchi, Rome (IT); Marco Caimmi, Rome (IT); Federico Vicentini, Rome (IT); Lorenzo Tosatti Molinari, Rome (IT)

(73) Assignee: CONSIGLIO NAZIONALE DELLE RICERCHE, Rome (IT)

( * ) Notice: Subject to any disclaimer, the term of this patent is extended or adjusted under 35 U.S.C. 154(b) by 519 days.

(21) Appl. No.: 14/364,267

(22) PCT Filed: Dec. 19, 2012

(86) PCT No.: PCT/IB2012/057461
§ 371 (c)(1),
(2) Date: Jun. 10, 2014

(87) PCT Pub. No.: WO2013/093787
PCT Pub. Date: Jun. 27, 2013

(65) Prior Publication Data

US 2014/0378876 A1 Dec. 25, 2014

(30) Foreign Application Priority Data

Dec. 20, 2011 (IT) ..... MI2011A2325

(51) Int. Cl.
*A61H 1/00* (2006.01)
*A61H 1/02* (2006.01)

(52) U.S. Cl.
CPC ..... *A61H 1/005* (2013.01); *A61H 1/0266* (2013.01); *A61H 2001/0207* (2013.01);
(Continued)

(58) Field of Classification Search
CPC . A61H 1/00; A61H 1/005; A61H 1/02; A61H 2001/0203; A61H 2001/0207;
(Continued)

(56) References Cited

U.S. PATENT DOCUMENTS 6,878,102 B1 4/2005 Commisso
2005/0148919 A1* 7/2005 Beny ..... A61H 1/0266 602/28

(Continued)

FOREIGN PATENT DOCUMENTS

| | | | |
|---|---|---|---|
| CN | 101006958 | A | 8/2007 |
| DE | 93 12 252 | U1 | 1/1994 |
| EP | 0 496 528 | A1 | 7/1992 |
| FR | 2 635 457 | A1 | 2/1990 |
| WO | WO 2005/060913 | A1 | 7/2005 |

OTHER PUBLICATIONS

International Search Report for corresponding International Patent Application No. PCT/IB2012/057461 mailed Mar. 15, 2013.
Gosselin, C. et al. "On the Development of the Agile Eye", IEEE Robotics & Automation Magazine, IEEE Service Center, Piscataway, NJ, vol. 3, No. 4, Dec. 1, 2996, pp. 29-37.

(Continued)

*Primary Examiner* — Rachel Young
(74) *Attorney, Agent, or Firm* — Merchant & Gould P.C.

(57) ABSTRACT

A device (7) for the rehabilitation of the movements of the foot (1) includes a supporting base (8) and a mobile platform (9) with a supporting surface (10) for resting the sole of the foot (1), wherein the mobile platform (9) is secured to the supporting base (8) by a pure rotation movement mechanism (12) with three degrees of freedom of rotary movement independent the one from the other and placed in parallel which allow rotations of the mobile platform around three axes (13, 14, 15) which intersect one another in a single rotation center (P). The supporting surface (10) is turned towards the rotation center (P) and is distant from the rotation center (P) in such a way that the rotation center (P) is positioned in correspondence to the ankle (2) of the foot (1).

14 Claims, 5 Drawing Sheets

(52) U.S. Cl.
CPC .. *A61H 2201/10* (2013.01); *A61H 2201/5058* (2013.01); *A61H 2201/5064* (2013.01); *A61H 2201/5071* (2013.01); *A61H 2230/605* (2013.01)

(58) Field of Classification Search
CPC ... A61H 2201/10; A61H 2201/12–2201/1215; A61H 2201/164–2201/1642; A61H 2201/1671–2201/1676; A61H 2201/5053; A61H 2201/5058–2201/5074; A61H 2205/125; A61H 2230/605; A63B 21/4015; A63B 21/4034; A63B 21/4043; A63B 21/4047–21/4049; A63B 22/14–22/18; A63B 2022/185; A63B 23/08–23/10
See application file for complete search history.

(56) References Cited

U.S. PATENT DOCUMENTS

2009/0149855 A1* 6/2009 Iwaki ..... A61H 1/0237 606/57
2011/0306473 A1* 12/2011 Saglia ..... A61H 1/0266 482/79

OTHER PUBLICATIONS

Gosselin, C. et al. "On the Kinematic Design of Spherical Three-Degree-of-Freedom Parallel Manipulators", International Journal of Robotics Research, Sage Science Press, Thousand Oaks, CA vol. 12, no. Aug. 1, 2993, pp. 394-402.

* cited by examiner

DEVICE FOR THE REHABILITATION OF MOVEMENTS OF THE FOOT

This application is a National Stage Application of PCT/IB2012/057461, filed 19 Dec. 2012, which claims benefit of Serial No. MI2011A002325, filed 20 Dec. 2011 in Italy and which applications are incorporated herein by reference. To the extent appropriate, a claim of priority is made to each of the above disclosed applications.

BACKGROUND OF THE INVENTION

The present invention refers in general to devices and methods for the neuromuscular rehabilitation of foot movements. In particular, the present invention concerns a device and a method for neuromuscular rehabilitation relating to the mobility of the ankle.

Known rehabilitation devices typically present a platform securable to the foot of a patient and connected to a movement mechanism configured for a passive mobilization of the foot and/or to assist the patient during active movements (assisted mobilization). Such devices should, in the ideal case, satisfy the following fundamental therapeutic requirements:

- ensure that both the passive movement and the active movement of the musculoskeletal apparatus comply with the physiological movement of the limbs and of the joints;
- control, monitor and/or increase the movement range of the foot (the so-called articulation capacity or "ROM" range of motion) compatibly with the physiological movements;
- monitor the intensity of the force produced by the muscles of the lower limb and the foot and/or exercise the muscles during foot movement.

With particular reference to the rehabilitation of patients with neurological illnesses, e.g., during after-stroke rehabilitation or patients with spinal cord injuries, where the aim is the recovery of foot movement control, the need arises to monitor the intensity of muscle activity and/or simulate muscle contraction.

Because of the complexity of ankle joints, the devices of prior art do not satisfy the above-listed requirements, in particular with reference to compliance with physiological movement.

SUMMARY OF THE INVENTION

The purpose of the present invention is therefore to provide a device for neuromotiv rehabilitation of foot movements, said device having characteristics such as to ensure a foot movement highly compatible with its physiological movement.

In agreement with aspects of the invention, the device comprises:

- a support base for resting the device on an application environment (e.g., a floor, a bed or a chair);
- a mobile platform with a supporting surface to rest the sole of the foot and securing means configured to secure the foot to the mobile platform, wherein the mobile platform is secured to the supporting base by means of a movement mechanism with at least two degrees of freedom of rotary movement which permits only rotations of the platform with respect to the supporting base around axes intersecting one another in a single point forming a centre of rotation, wherein the supporting surface of the mobile platform is turned towards said centre of rotation and is at a distance from the centre of rotation in such a way that, with the foot resting on the supporting surface and secured to the mobile platform, the centre of rotation is in the ankle.

Thanks to the positioning of the centre of rotation of all the possible rotations of the mobile platform at the ankle, the active and passive rotary movements of the foot secured to the platform occur around rotation axes highly compatible with the tibiotarsal joint dorsiflexion and plantarflexion and the anatomically correct subtalar inversion and eversion.

In agreement with one aspect of the invention, the mobile platform is secured to the supporting base by means of a movement mechanism with three rotational degrees of freedom which permits only rotations of the platform with respect to the supporting base around axes intersecting one another in the centre of rotation.

The third rotational degree of freedom permits internal or external, active or passive tibial rotations of the lower limb highly compatible with the natural anatomic condition. This way, a rotation of the foot is also allowed about an axis passing between knee and ankle. Such a rotation occurs naturally because of the coupling of the tibial rotation movement with the subtalar rotation.

In agreement with a further aspect of the invention, the mobile platform is secured at the support base by means of a spherical parallel kinematic movement mechanism with three rotational degrees of freedom. In particular, the mobile platform is connected to the base by means of three articulated links, made up of two rigid segments and three rotary joints the rotation axes of which intersect one another in the rotation centre, in such a way that all the links of the kinematic chain thus configured are forced to perform a spherical movement around the same rotation centre. The mechanisms for the support and the movement of an object with spherical parallel kinematic movement are distinguished by the fact that the object itself can only perform rotations around a single point which remains fixed in space and wherein the mechanism consists of a plurality of kinematic chains arranged in parallel relationship with one another.

The spherical kinematic with three degrees of freedom of rotary movement allows the passive support of the mobile platform (i.e., a purely mechanical support of the mobile platform at point P without active movement of the platform by means of the support mechanism), but also its active movement of pure rotation with a high degree of intrinsic rigidity and, therefore, with a high reliability as regards maintaining the position of the rotation centre with respect to the support base and to the mobile platform.

In agreement with a further aspect of the invention, the device comprises a plurality of actuators connected to the movement mechanism and configured to move the mobile platform (together with the foot secured to it) in a controlled way with respect to the support base.

This permits both a mobilization of the passive type and an assisted active mobilization with physiological characteristics for the training of hypoactivating persons. Such passive or assisted movement can be aimed at neuromuscular stimulation (in the case of neurological rehabilitation), at increasing the mobility range of the joints (ROM range of motion) and at proprioception.

In agreement with a further aspect of the invention, the device comprises means of resistance connected to the movement mechanism and configured to generate resisting moments of controlled size and direction, said moments acting against a movement of the mobile platform (together with the foot secured to it) with respect to the supporting base.

This permits training neuromuscular action and stimulating the intensity of muscle force and of the nervous signals, both within the scope of a neurological or post-trauma rehabilitation, and in the scope of gymnastic training.

In agreement with a further aspect of the invention, the device comprises:

sensor means associated with the movement mechanism and configured to detect quantities indicative of the position of the mobile platform and of the forces transmitted by the foot to the mobile platform, a control unit connected with the sensor means and with the actuators and/or the means of resistance, wherein the control unit is configured to operate the actuators and/or the means of resistance in such a way as to affect the movement of the mobile platform according to the quantities detected by the sensor means and to a preset movement program.

The movement program can be a standardized rehabilitation program, which can be loaded on a data storage device readable by the control unit and adaptable in agreement with a specific therapeutic plan established by the doctor, or with a movement program selectable from a plurality of therapeutic programs contained in a databank loaded on a data storage device.

In the same way, the movement program can be a standardized gymnastic training program, which can be loaded on a data storage device readable by the control unit and adaptable in agreement with a specific training plan.

The invention also concerns a gymnastic or neuromotiv method for the rehabilitation of the foot joints, the method comprising the following phases:

resting the sole of the foot on a support surface of a mobile platform with at least two degrees of freedom of rotary movement which only allow the platform to rotate around axes intersecting one another in a single point which makes up a rotation centre, moving the foot together with the platform, characterised by the fact of positioning and securing the foot to the mobile platform in such a way that said rotation centre is at the ankle of the foot.

In agreement with one aspect of the invention, the method contemplates the phase of securing the mobility of the platform to a mobility of pure rotary movement with three degrees of freedom around axes intersecting one another in a single point, by means of a spherical parallel kinematic mechanism.

BRIEF DESCRIPTION OF THE DRAWINGS

To better understand the invention and appreciate its benefits, some of its embodiments will be described below by way of non-limiting example, making reference to the attached illustrations wherein:

the FIG. 1 is a schematized illustration of the joints of the human foot;

Figure 2:
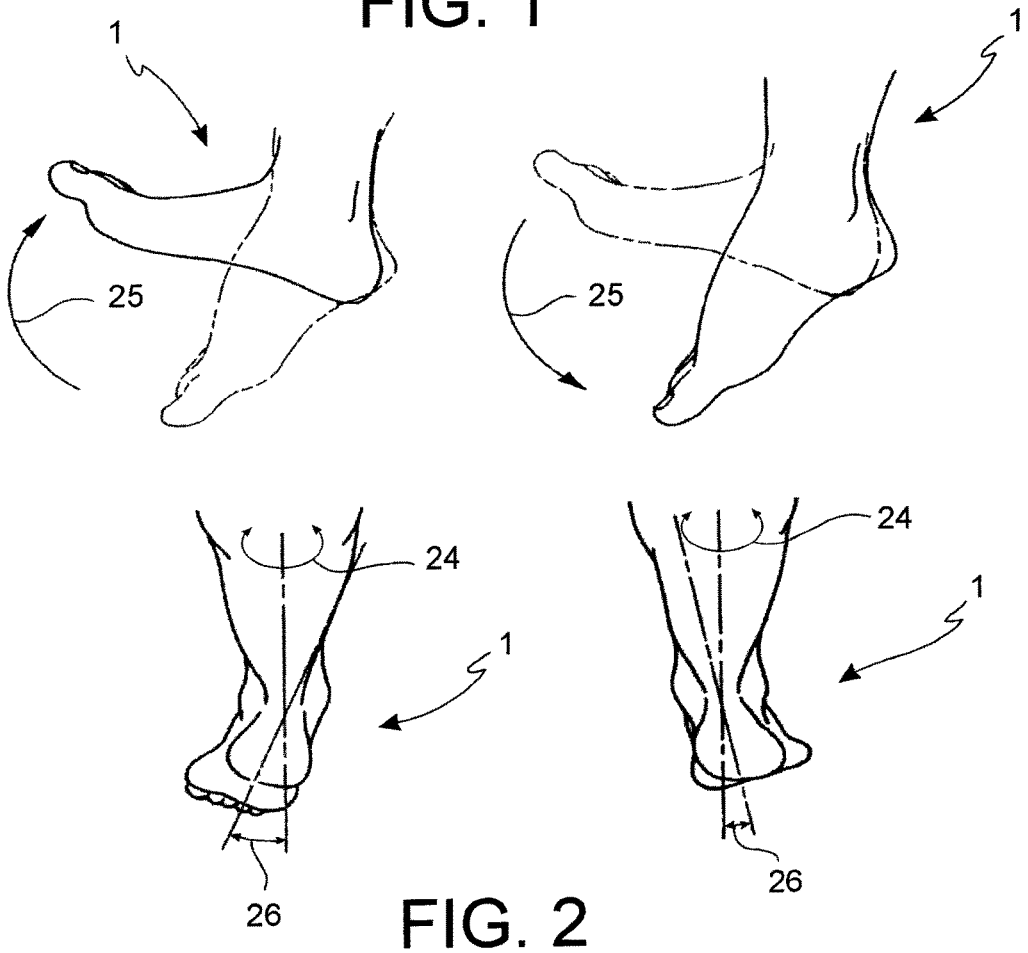
Figure 3:
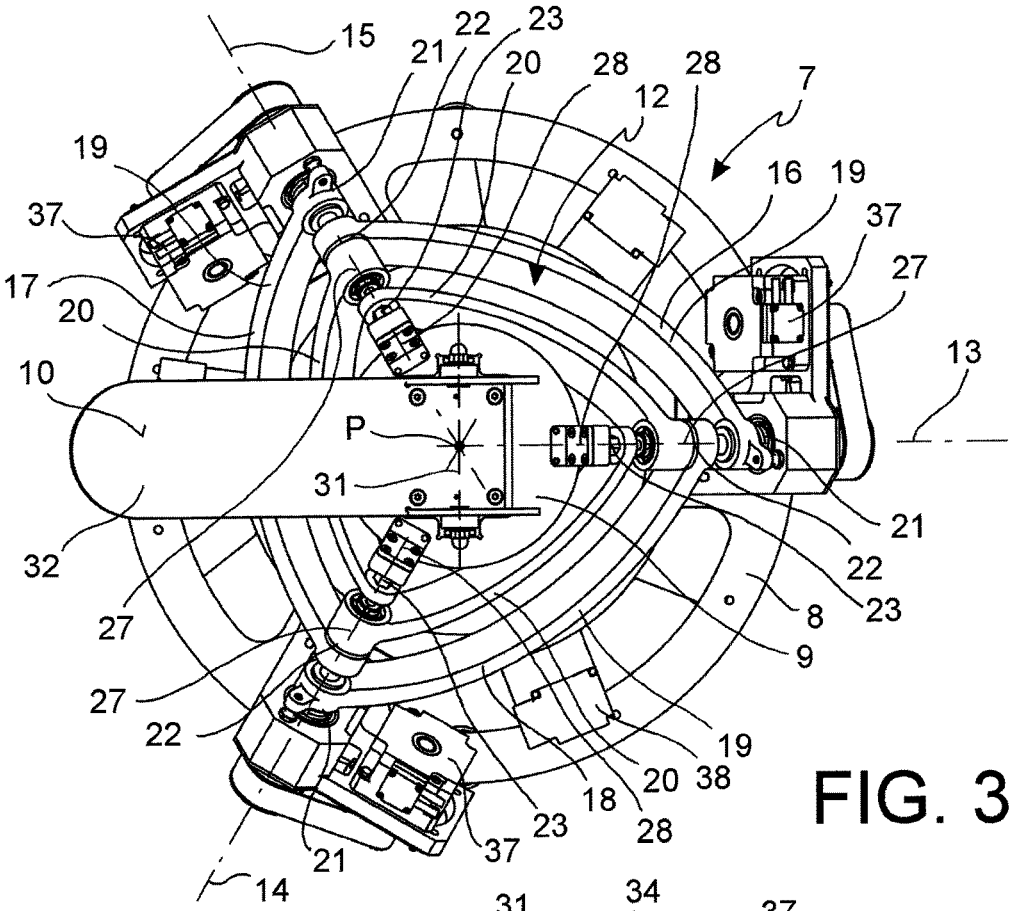
Figure 4:
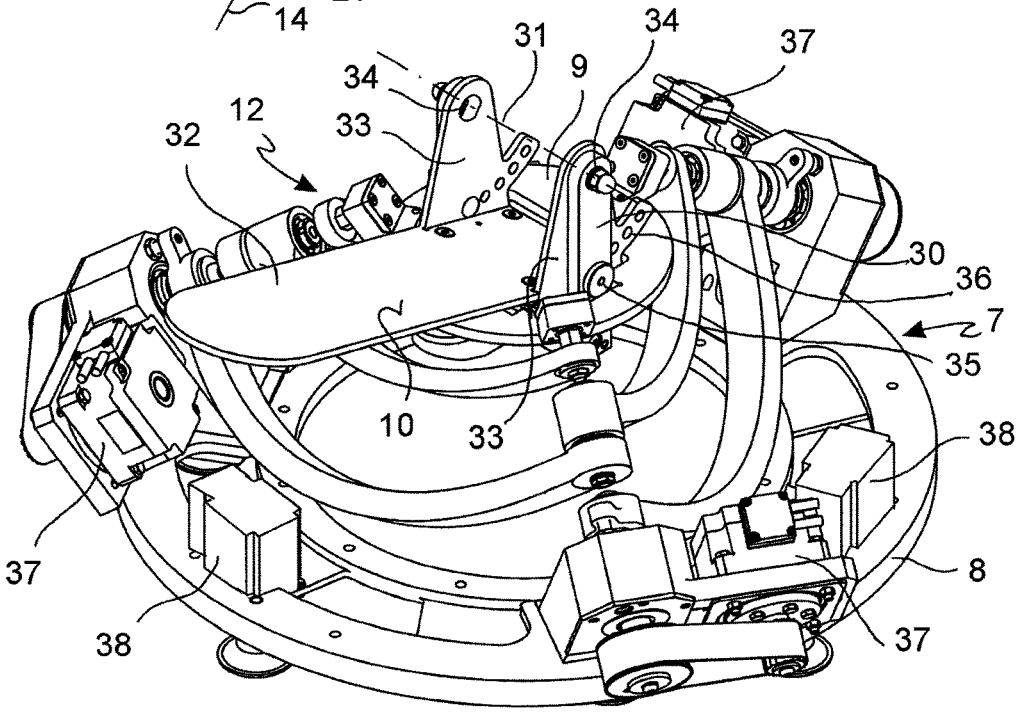
Figure 5:
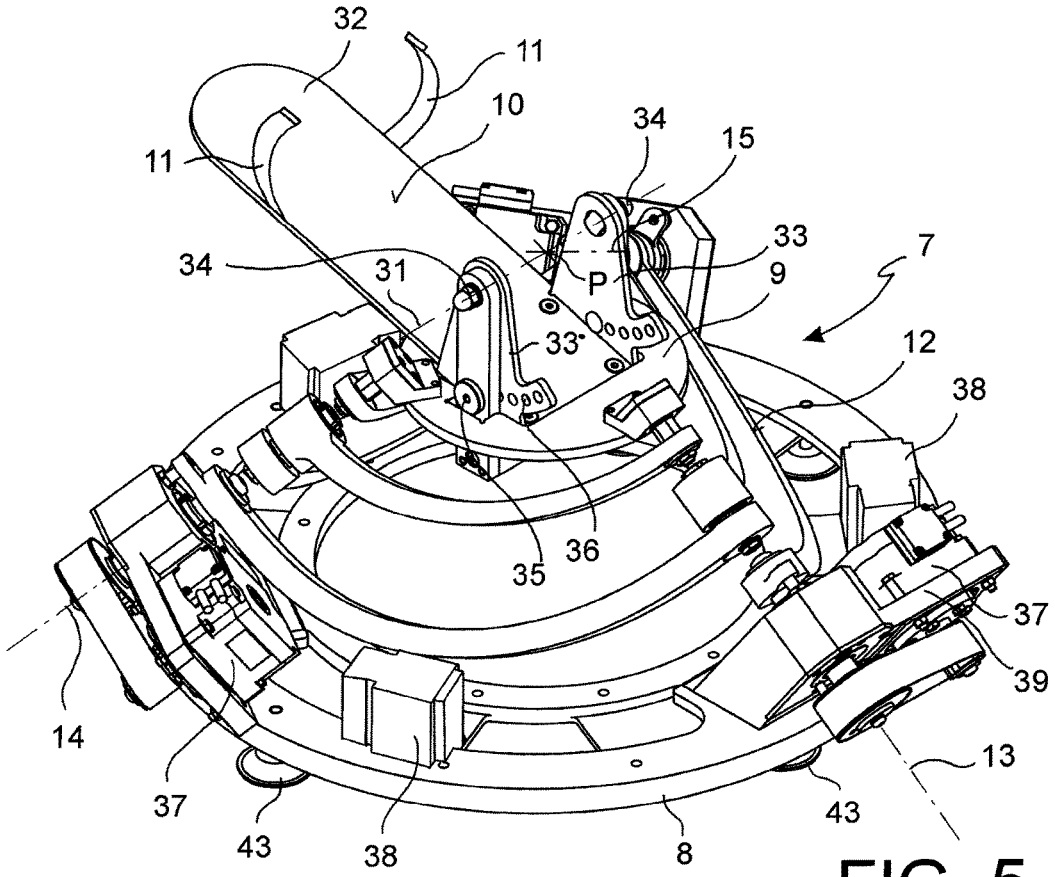
Figure 6:
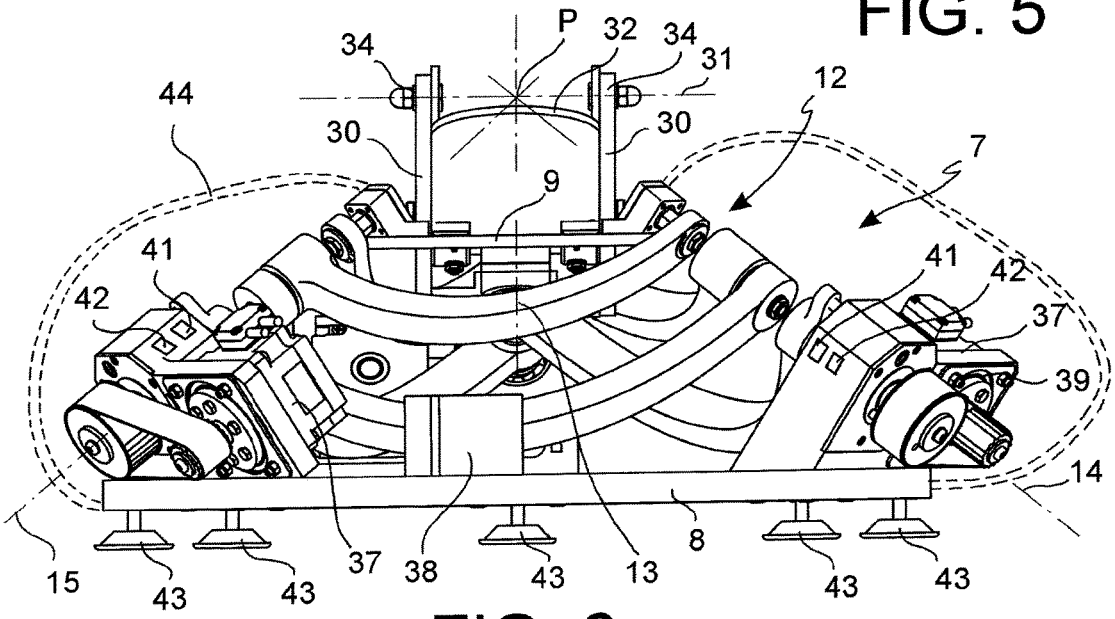
Figure 7:
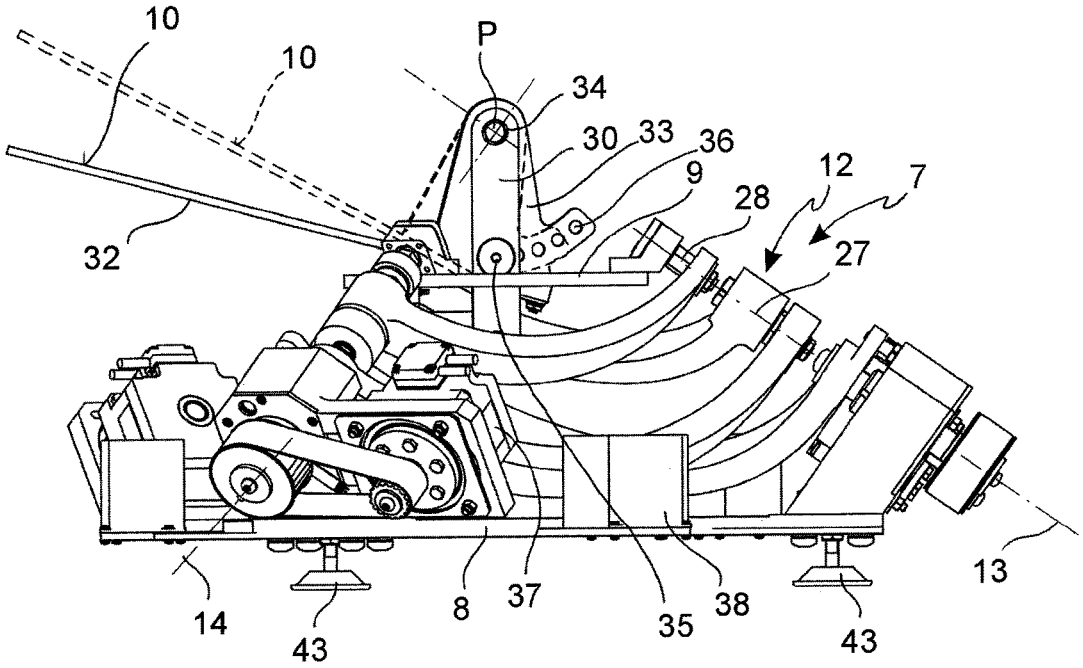
Figure 8:
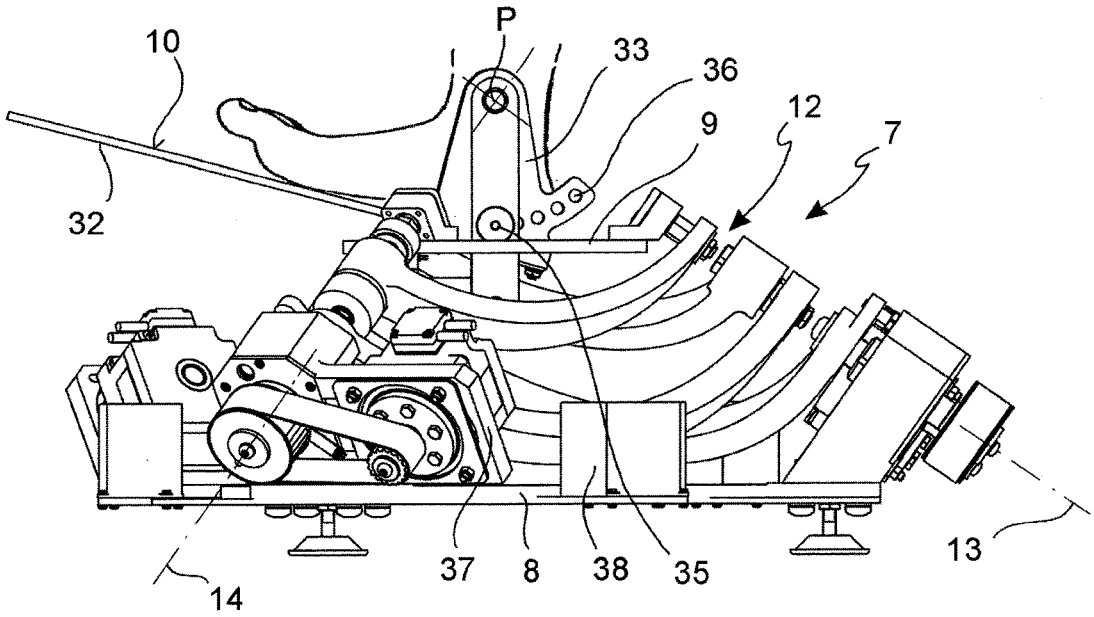
Figure 9:
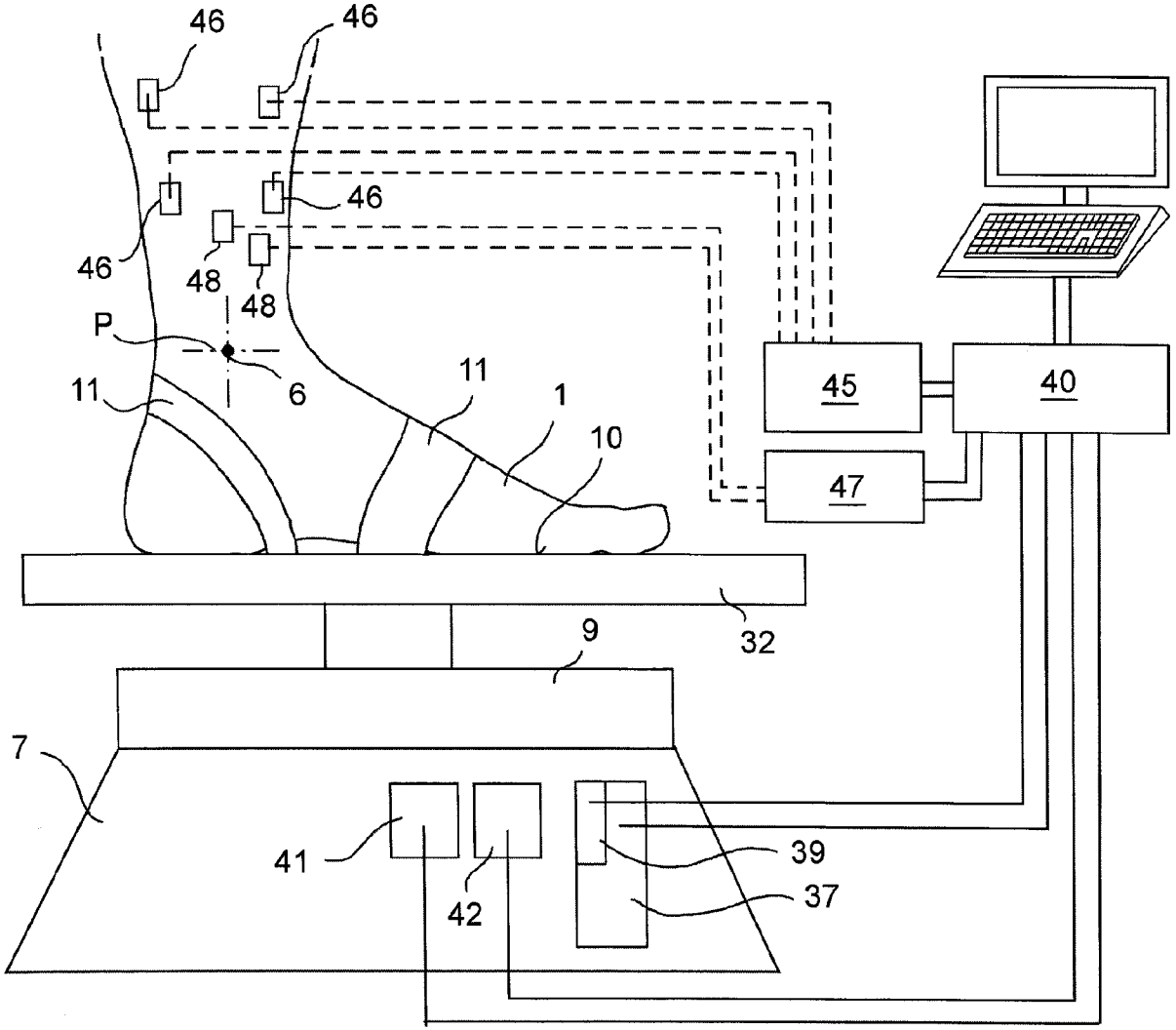

the FIG. 2 is a schematized illustration of the three main rotations in the ankle of the foot in agreement with natural anatomy;

the FIG. 3 is a view from above of a device for the neuromuscular rehabilitation of the foot joints according to one embodiment;

the FIG. 4 is an axonometric view of the device in FIG. 3;

the FIG. 5 is a further axonometric view of the device in FIG. 3;

the FIG. 6 is a front view of the device in FIG. 3;

the FIG. 7 is a side view of the device in FIG. 3 with a mobile platform in two adjustment configurations;

the FIG. 8 is a side view of the device in FIG. 3 with indication of the position of a foot secured to a mobile platform of the device;

the FIG. 9 is a schematized representation of the control and command system of the device according to one embodiment.

DETAILED DESCRIPTION OF THE PREFERRED EMBODIMENT

Figure 1:
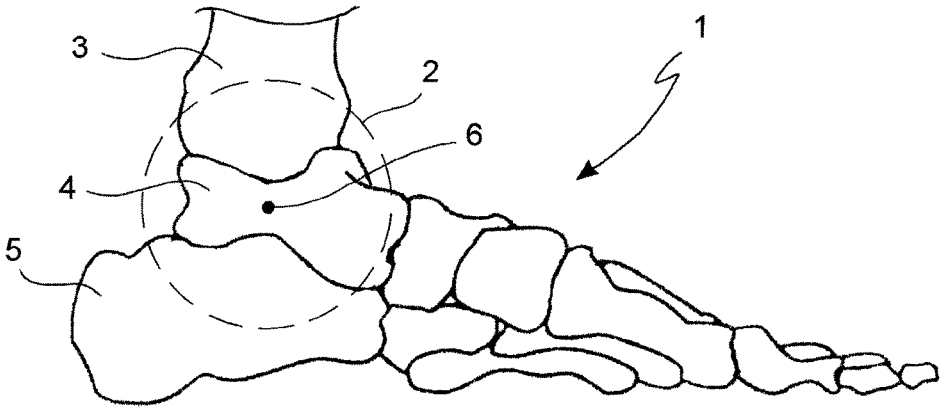

The FIGS. 1 and 2 show the joints of the human ankle and the main movements of the human foot 1 produced by the relative movements between the bones making up these joints.

Within this description, by the term ankle 2 is meant all the joints made up of the lower extremities of the tibia 3 and of the fibula, of the ankle bone 4 and of the heel 5.

As shown in the FIG. 2, the joints of the ankle 2 are involved in the following rotations:

the internal and external tibial rotation (arrow 24) which occurs around a rotary axis passing through the centre of the knee and the centre of the ankle 2;

the tibiotarsal joint dorsiflexion and plantarflexion (arrow 25), commonly known as articulation of the ankle. Such rotation is the result of a relative sliding between the lower surfaces of the tibia 3 and the fibula and the upper surface of the ankle bone 4, which determines a rotation around an axis normal to the saggital plane and passing through the medial malleolus and the lateral malleolus. The conformation of the bones making up the entire articulation determines a variable inclination of the axis around which the tibiotarsal joint dorsiflexion and plantarflexion occurs with respect to the parasaggital according to the dorsiflexion/plantarflexion angle. Nevertheless, the variation of the inclination of the flexion axis and foot extension can also be modelled like a rotation of the axis around a point arranged on the axis itself and inside the ankle 2.

the subtalar inversion/eversion (arrow 26) resulting from a sliding between the ankle bone 4 and the heel 5. The subtalar inversion/eversion determines a rotation around an axis belonging to the parasaggital, the direction of which is oriented more or less like the bisector of the front and transversal planes.

From an anatomic viewpoint, the described rotation axes are not exactly intersecting but, according to the invention, such rotation axes can be approximated as intersecting one another in a single point (hypothetic rotation centre 6) both for rehabilitation purposes and for gymnastic training.

According to one aspect of the invention, the position of the hypothetic rotation centre 6 can be approximated with the medium point of the segment of minimum distance between such axes, positioned more or less at centre, in particular at mid height of the ankle bone 4 (FIG. 1).

Starting with the idea of a presumed intersection of all three rotation axes of the foot in a single point (hypothetical rotation centre 6) in the ankle 2, the further idea was formed of guiding or moving the foot by means of a movement of sole rotations around intersecting axes in a single point P (guided rotation centre) positioned, at least approximately, in the hypothetical rotation centre 6 of the foot itself. The result of such approach is a surprising compatibility of the movement guided or assisted or "imparted" by the outside of the foot 1, with anatomically correct movements.

The figures from 3 to 8 show a device 7 for the neuromotiv rehabilitation of the joints of the foot 1. The device 7 comprises a supporting base 8 for resting or fitting the device 7 on an application environment (e.g., a floor, a bed or a chair), as well as a mobile platform 9 with a supporting surface 10 for resting the sole of the foot 1. The mobile platform 9 also has securing means 11 configured to secure the foot 1 to the mobile platform 9. The mobile platform 9 is secured to the supporting base 8 by means of a movement mechanism 12 with at least two degrees of freedom of rotary movement, preferably three degrees of freedom of rotary movement, which allows only rotations of the mobile platform 9 with respect to the supporting base 8 around axes 13, 14, 15 intersecting one another in a single point which forms a rotation centre P. The supporting surface 10 of the mobile platform 9 is turned towards such rotation centre P and is distant from the rotation centre P in such a way that, with foot 1 resting on the supporting surface 10 and secured to the mobile platform 9, the rotation centre P is at the ankle 2 of the foot itself.

Thanks to the positioning of the rotation centre P of all the possible rotations of the mobile platform 9 in the hypothetical rotation centre of the ankle 2, the active or passive rotary movements of the foot 1 secured to the platform 9 occur around rotation axes highly compatible with the tibiotarsal joint dorsiflexion and plantarflexion and the anatomically correct subtalar inversion and eversion.

In agreement with one embodiment, the movement mechanism 12 is a mechanism with three degrees of freedom of rotary movement which only permit rotations of the platform 9 with respect to the supporting base 8 around axes 13, 14, 15 intersecting one another in the rotation centre P. The provision of three degrees of freedom of rotary movement also permits for example the internal or external, active or passive tibial rotations of the lower limb in a way highly compatible with the natural anatomical condition.

In agreement with one advantageous embodiment, the mobile platform 9 is secured to the supporting base 8 by means of a spherical parallel kinematic movement mechanism 12 with three degrees of freedom of rotary movement. In particular, the mobile platform 9 is connected to the supporting base 8 by means of three articulated links 16, 17, 18, formed of two rigid segments 19, 20 and three rotary joints 21, 22, 23 respectively, the rotation axes of which all intersect one another in the rotation centre P, in such a way that all the links 16, 17, 18 of the kinematic chain thus configured are secured to perform a spherical movement around the same rotation centre P.

The spherical kinematic with three degrees of freedom of rotation allows the passive support of the mobile platform 9 and its active movement of pure rotation with a high intrinsic rigidity and, therefore, with a high reliability of maintaining the position of the rotation centre P with respect to the supporting base 8 and to the mobile platform 9.

In agreement with one embodiment, each articulated link 16, 17, 18 comprises a first rigid segment 19 secured to the supporting base 8 (by means of a first joint 21) in a rotatable way and, advantageously, actuatable to rotate, around just one actuation axis 13, 14, 15 which passes through the rotation centre P, while relative rotations around axes other than the actuation axis 13, 14, 15 and any relative translation between the first rigid segment 19 and the supporting base 8 are prevented. Such a constraint of pure rotation around just one axis can be achieved for example by means of a revolving support with a cylindrical rollers revolving bearing or with two revolving ball bearings distanced in the direction of the actuation axis 13, 14, 15.

A second rigid segment 20 can be secured to the first rigid segment 19 (by means of a second intermediate joint 22) in a rotatable and idle way around just one intermediate articulation axis 27 which passes through the rotation centre P, while relative rotations around axes other than the intermediate articulation axis 27 and any relative translations between the second rigid segment 20 and the first segment 19 are prevented. Such a constraint of pure rotation around just one axis can be archived for example by means of a rotatable connection with a cylindrical rollers revolving bearing or two revolving ball bearings distanced in the direction of the intermediate articulation axis 27.

The mobile platform 9 can be secured to the second rigid segment 20 (by means of a third joint 23) in a rotatable and idle way around just one third articulation axis 28 which passes through the rotation centre P, while relative rotations around axes other than the third articulation axis 28 and any relative translations between the mobile platform 9 and the second rigid segment 20 are prevented. Such a constraint of pure rotation around just one axis can be achieved for example by means of a rotatable connection with a cylindrical-roller revolving bearing or two revolving ball bearings distanced in the direction of the third articulation axis 28.

The result is a movement mechanism 12 with three links 16, 17, 18, wherein each link realizes a kinematic chain of the RRR (actuated rotation—Idle rotation—Idle rotation) type.

In order to make assembly easier and limit the internal resistance of such a hyperstatic structure, it is also possible to realize the intermediate joint 22 or, alternatively, the third joint 23 as ball joint with only spherical rotation around a point of the joint itself, so as to obtain links 16, 17, 18 that realize kinematic chains of the RRS (actuated rotation—Idle rotation—Idle spherical rotation) type or RSR (actuated rotation—Idle spherical rotation—Idle rotation) type.

In agreement with one embodiment, the movement mechanism 12 is configured in such a way that at least the first rigid segments 19 of all the links 16, 17, 18 always remain inside just one half-sphere developed around the rotation centre P or, in other words, they always remain inside just one half of a sphere developed around the rotation centre P.

Advantageously, both the rigid segments 19, 20 of all the links 16, 17, 18 always remain inside just one half-sphere developed around the rotation centre P or, in other words, they always remain inside just one half of a sphere developed around the rotation centre P.

Even more advantageously (FIGS. 6, 7), the supporting base 8 and the entire movement mechanism 12 containing both the rigid segments 19, 20 and the three rotary joints 21, 22, 23 of all the links 16, 17, 18 always remain inside just one half-sphere developed around the rotation centre P or, in other words, they always remain inside just one half of a sphere developed around the rotation centre P. Expressed in other words, the half-sphere is to be deemed a half-space delimited by a plane containing the point which forms the rotation centre P and, in agreement with embodiments, this plane too (and therefore the half-space containing the components described above) can rotate in said point P.

Thanks to the positioning of the moving parts of the movement mechanism on just one side of a plane passing through the rotation centre P, the supporting surface 10 of the mobile platform 9 is easily accessible and avoids any undesired interference between the foot and the leg of the user and the movement mechanism 12.

In agreement with one advantageous embodiment, but not necessarily, each of the three actuation axes 13, 14, 15 defines a 90° angle with the other two axes.

In order to be able to adapt the device 7 to different foot shapes and sizes and always allow the positioning of the rotation centre P at the ankle 5, the device 7 itself has means for adjusting the position of the supporting surface 10 with respect to the rotation centre P.

In agreement with one embodiment, the adjustment means comprise angular adjustment means configured to adjust at least one positioning angle (possibly two or three angles) of the supporting surface 10 with respect to the mobile platform 9 and to secure the supporting surface 10 in the adjusted angular position with respect to the platform 9. Advantageously, at least one angular adjustment axis 31 of the angular adjustment means intersects the rotation centre P of the device 7.

This permits, for example, adapting the supporting surface 10 to a different inclination of the foot according to the position (e.g., sat, lying down or standing) of the user.

By way of a non-limiting example, the supporting surface 10 can be made up of a supporting plate 32 to which are connected two side walls 33 which in turn are hinged to two uprights 30 of the mobile platform 9. The hinges 34 between the uprights 30 and the side walls 33 of the supporting plate 32 can be made by means of bolt connections and define the above angular adjustment axis 31. The securing of the supporting plate 32 in the chosen angular position can occur by means of the tightening of the bolts forming the hinge or by means of a retention pin 35 connected to the upright 30 and insertable in a selectable hole of a plurality of retention holes 36 formed in the side wall 33 or vice versa.

In agreement with one embodiment, the adjustment means comprise translational adjustment means configured to adjust the distance between the supporting surface 10 and the rotation centre (P) and to block the supporting surface 10 at the adjusted distance.

For this purpose, the side walls 33 can be connected in a way movable and securable to the supporting plate 32. Alternatively, one or more shims can be contemplated which can be rested on the supporting plate 32 or connected to it in such a way as to adjust the distance between the rotation centre P and the sole of the foot rested on the shims.

In agreement with one embodiment, the device comprises a plurality of actuators 37 connected to the movement mechanism 12 and configured to move the mobile platform 9 (together with the foot 1 secured to it) in a controlled way with respect to the supporting base 8. The actuators 37 can comprise electric motors, e.g., brushless motors without or with reduction gear (gear motor), connected directly ("direct drive") or by means of a transmission, e.g., a belt, gear, chain, etc., to the links 16, 17, 18, in particular to the first rigid segment 19 (actuated) of each link in such a way as to be able to move it around the respective actuating axis 13, 14, 15.

The actuators 37 can be operated in a controlled way and according to a therapeutic plan by means of a control unit (e.g., a computer with user interface, processor and storage memory) connected for example to power amplifiers 38 (drivers) which drive the electric motors.

This permits a passive or assisted active movement of the foot 1, for example in the presence of insufficient neuromuscular stimulation, in conformity with the natural anatomical conditions. Such a passive or slaved movement can be aimed at neuromuscular stimulation (in the case of neurological rehabilitation), increasing the range of mobility of the ankle joints (in the case of post-trauma rehabilitation) or teaching specific movement cycles and/or specific stretchings within a gymnastic training program.

According to a further embodiment, the device 7 comprises means of resistance 37 connected to the movement mechanism 12 and configured to produce resistant moments of controlled size and direction, wherein such moments act against a movement of the mobile platform 9 (together with the foot 1 secured to it) with respect to the supporting base 8. Advantageously, the means of resistance 37 can be realized by the actuators 37 themselves which are therefore contemplated for a passive movement of the foot and to resist in a planned and interactive way and, therefore, to stimulate the active neuromuscular action of the limb.

In agreement with a further embodiment, the device 7 comprises sensor means 39 associated with the movement mechanism 12 and configured to detect quantities indicative of the position of the mobile platform 12 and of the loads (in particular moments) transmitted by the foot 1 to the mobile platform 9. The control unit 40 is connected to the sensor means 39 and the actuators and/or means of resistance 37 and configured to operate the actuators and/or the means of resistance 37 in such a way as to affect the movement of the mobile platform 9 according to the quantities detected by the sensor means 39 and a preset movement program.

The sensor means 39 can be embodied by electric motors (e.g., brushless motors) with encoder (e.g., with Hall effect) which provide the control unit 40 with signals indicating the angular position, angular speed, and the electrical quantities of the motors, on the basis of which the control unit calculates the loads on the mobile platform 9 and pilots the operation of the actuators 37 themselves. In order to ensure a control redundancy, auxiliary position sensors 41 can be provided and/or auxiliary mechanical load sensors 42, e.g., one or more potentiometric encoders connected to the movement mechanism 12 and suitable for detecting the angular position between the links 16, 17, 18 and the mobile platform 9, as well as torque sensors fitted to the actuation joints 21 and configured to detect the moments acting on them. The auxiliary sensors 41, 42 are also connected in signal communication with the control unit 40, which pilots the actuators 37 according to the quantities detected by the sensor means 39 and by the auxiliary position sensors 41 and mechanical load sensors 42, as well as to the movement program loaded in the computer memory.

In agreement with a further embodiment, the device 7 comprises an electromyograph 45 connected in signal communication to the control unit 40 and having a plurality of surface or needle electrodes 46 applicable to the musculature of the lower limb, in such a way as to pick up and amplify neuromuscular impulses even in the case of such impulses not determining stresses and/or movements of the mobile platform 9 detectable by means of the previously-described sensors 39, 41, 42.

In this embodiment, the control unit 40 can also be configured to pilot the actuators 37 according to the signals transmitted by the electromyograph 45, i.e., according to the neuromuscular impulses detected by means of the electrodes 46. This, for example, permits moving a patient's foot according to the detected neuromuscular impulses (inasmuch as the neuromuscular stimulations are representative of the muscular activity) in such a way as to stimulate the intensity of the impulse itself and to "teach again" the anatomically correct movements associated with such neuromuscular stimulations. This favours a recovery of the selective motive control and a correct timing of neuromuscular activation.

In agreement with a further embodiment, the device 7 comprises an electrostimulator 47 connected in signal communication to the control unit 40 and having a plurality of surface or needle electrodes 48 applicable to the muscles of the lower limb, in such a way as to apply electric stimulation impulses to the musculature. The electrostimulator 47 is suitable for generating the electric stimulation impulses according to the control signals received from the control unit 40, which controls the electrostimulator 47 and the actuators 37 on the basis of a predefined rehabilitation program.

The actuators 37 can be controlled using a control method based on inverse kinematic calculation for the spherical parallel kinematic mechanisms. The control method does not form the subject of the present invention inasmuch as known in the robotics sector. The equations of direct and inverse kinematics to control the actuators of spherical parallel kinematic mechanisms have been, for example, published by the University of Laval, Quebec City, Canada. The control software can for example implement the methods and principles described in the publications "*On the development of the Agile Eye," Robotics & Automation Magazine, IEEE*, vol. 3, no. 4, pages 29-37, December 1996, as well as "*On the kinematic design of spherical three-degrees-of-freedom parallel manipulators*", International Journal of Robotics Research 12(4):394-402.

The movement program can be a standardised rehabilitation program, loadable on a data storage device readable by the control unit 40 and adaptable in agreement with a specific therapeutic plan established by the doctor, or a movement program selectable among a plurality of therapeutic programs contained in a database loaded on a data storage device.

In the same way, the movement program can be a gymnastic training program, loadable on a data storage device readable by the control unit 40 and adaptable in agreement with a specific training plan.

In agreement with an embodiment, the supporting base 8 can include a rigid frame, e.g., annular, substantially flat, which supports the actuation joints 21 of the movement mechanism 12 and the actuators 37 with the relative power amplifiers (drivers) 38. The supporting base 8 can also comprise adjustment means, e.g., three feet 43 adjustable in height, for adjusting the relative position between the supporting base 8 and the floor.

In agreement with a further embodiment, the supporting base 8 can also comprise fastening means, e.g., a fastening bracket with tightening screws (not shown in the figures) for the rigid fastening of the device 7 to an application environment, e.g., a chair or a bed.

The securing means 11 can include tightening clamps fixed to the supporting plate 32 and configured to be extendable around a foot resting on the supporting surface to secure the foot to the latter.

The supporting base 8, the articulated links 16, 17, 18, the mobile platform 9 and the supporting plate 32 can be made of metal, e.g., aluminium, or synthetic material if necessary fibre reinforced, as well as of composite material, e.g., a carbon matrix reinforced with carbon or glass fibres. This way, it is possible to reconcile a high degree of rigidity with a low weight which favours the transportability of the device 7.

The movement mechanism is advantageously covered with a flexible film or a foldable fabric 44 connected to the supporting base 8 and to the mobile platform 9.

The device 7 described thus far has a number of advantages. It permits both continuous passive movement (CPM) and the cooperation between the patient and the movement mechanism 12 based on the measurement of the forces transmitted between the foot 1 and the mobile platform 9, ensuring a high compatibility of the performed movements with the natural anatomical characteristics. This way, the device 7 acts like an exoskeleton for the foot, respecting its real mobility and avoiding any possible compensatory movements by the patient. This permits acting on the joints, on the bundles of muscles and on the neurological system in a purposefull way and also favours neuro-functional recovery thanks to greater patient participation in the therapy.

As has already been previously mentioned and several times evidenced during the description of the device 7, the invention also concerns a gymnastic method or foot articulation neuro motor rehabilitation method, the method comprising the following phases:

resting the sole of the foot on a supporting surface of a mobile platform having at least two degrees of freedom of rotary movement which only permit rotations of the platform around axes that intersect one another at a single point forming a rotation centre, moving the foot together with the mobile platform, characterised by the fact of positioning and securing the foot to the mobile platform in such a way that said rotation centre is at the ankle of the foot.

Advantageously, the method comprises resting the sole of the foot on a supporting surface of a mobile platform having a mobility of pure rotation with three degrees of freedom around axes intersecting at a single point forming said rotation centre. Further phases and characteristics of the rehabilitation and/or gymnastic method have been described together with the description of the operation of the device 7 and are not repeated here for the sake of conciseness.

Obviously, to the device and the method according to the present invention, a technician in the field, for the purpose of satisfying contingent and specific requirements, may make further changes and variations, all of which nonetheless contained within the protection scope of the invention, as defined by the following claims.

The invention claimed is:

1. A device for rehabilitation of foot movements, said device comprising:

a supporting base for resting or fitting the device on an application environment, a mobile platform with a supporting surface for resting the sole of the foot and securing means configured for securing the foot to the mobile platform, a movement mechanism which constrains the mobile platform to the supporting base and which can be operated to move the mobile platform in pure rotation with three degrees of freedom of rotary movement around rotation axes intersecting one another in a single point forming a rotation center, wherein the movement mechanism comprises three articulated links, each of which connects the mobile platform to the supporting base and comprises two rigid segments and three rotary joints respectively, defining the rotation axes which all intersect one another in the rotation center, said three articulated links being arranged in parallel, wherein the supporting surface of the mobile platform is facing towards said rotation center and is distanced from the rotation center in such a way that the rotation center is positionable at the ankle of the foot resting on the supporting surface.

2. The device according to the claim 1, wherein the movement mechanism is configured in such a way as to only permit rotations of the mobile platform with respect to the supporting base around said rotation axes intersecting one another in the rotation center, relative translations between the mobile platform and the supporting base being prevented.

3. The device according to the claim 1, wherein each articulated link comprises:

a first rigid segment of said two rigid segments secured to the supporting base by a first joint in a rotatable way and actuatable in rotation by an actuator around only one first rotation axis of said rotation axes which passes through the rotation centre, relative rotations around axes other than the first rotation axis and any relative translation between the first rigid segment of said two rigid segments and the supporting base being prevented, a second rigid segment of said two rigid segments secured to the first rigid segment of said two rigid segments by a second intermediate joint in a rotatable and idle way around only one intermediate articulation axis which passes through the rotation centre, relative rotations around axes other than the intermediate articulation axis and any relative translation between the second rigid segment and the first rigid segment being prevented, a third joint securing the second rigid segment of said two rigid segments to the mobile platform in a rotatable and idle way around only one third articulation axis which passes through the rotation centre, relative rotations around axes other than the third articulation axis and any relative translation between the mobile platform and the second rigid segment of said two rigid segments being prevented.

4. The device according to claim 3, wherein both the rigid segments of all the articulated links always remain inside just one half-space developed around the rotation center.

5. The device according to claim 3, wherein the supporting base and the entire movement mechanism containing both the rigid segments and the three rotary joints of all the links always remain inside just one half-space developed around the rotation center.

6. The device according to claim 1, comprising means for adjusting the position of the supporting surface with respect to the rotation center.

7. The device according to the claim 6, wherein the means for adjusting comprise angular means for adjusting configured to adjust at least one positioning angle of the supporting surface with respect to the mobile platform and to block the supporting surface in said adjusted angular position.

8. The device according to the claim 6, wherein the means for adjusting comprise translational means for adjusting configured to adjust the distance between the supporting surface and the rotation center and to block the supporting surface at the adjusted distance.

9. The device according to claim 1, comprising:

a plurality of actuators connected to the movement mechanism and configured to move the mobile platform in a controlled way with respect to the supporting base, means for sensing associated with the movement mechanism and configured to detect quantities indicative of the position of the mobile platform and of the stresses transmitted to the mobile platform, a control unit in signal communication with the actuators and with the means for sensing and configured to control the actuators to affect the movement of the mobile platform in dependency of signals transmitted by the means for sensing and of a preset movement program.

10. The device according to claim 9, comprising an electromyograph with a plurality of electrodes applicable to a musculature, said electromyograph being suitable for picking up and amplifying neuromuscular impulses of said musculature, wherein the control unit is in signal communication with said electromyograph and is configured to control the actuators in such a way as to affect the movement of the mobile platform according to the neuromuscular impulses detected by the electromyograph.

11. The device according to the claim 9, comprising an electrostimulator connected in signal communication to the control unit and suitable for applying electric stimulation impulses to the musculature, wherein the electrostimulator generates electric stimulation impulses in dependency of control signals received from the control unit, and the control unit is configured to control the electrostimulator and the actuators on the basis of a preset rehabilitation program.

12. The device according to claim 1, comprising means for resisting connected to the movement mechanism and configured to generate resistant moments of controlled size and direction, wherein said resistant moments act against a movement of the mobile platform with respect to the supporting base.

13. The device according to claim 3, wherein the second intermediate joint or the third joint is configured as a spherical joint of spherical rotation only.

14. A device for rehabilitating foot movements, said device comprising:

a supporting base for resting or fitting the device on an application environment;

a mobile platform with a supporting surface for resting the sole of the foot and a fastener for securing the foot to the mobile platform;

a movement mechanism constraining the mobile platform to the supporting base, the movement mechanism being operable to move the mobile platform in pure rotation with three degrees of freedom of rotary movement around rotation axes intersecting one another in a single point forming a rotation center;

wherein the movement mechanism comprises three articulated links, each of the articulated links connecting the mobile platform to the supporting base and comprising two rigid segments and three rotary joints respectively, defining the rotation axes, the rotation axes all intersecting one another in the rotation center, said three articulated links being arranged in parallel;

wherein the supporting surface of the mobile platform is facing towards said rotation center and is distanced from the rotation center so that the rotation center is positionable at the ankle of the foot resting on the supporting surface.

* * * * *